US010232391B2

(12) United States Patent
Timmerman

(10) Patent No.: US 10,232,391 B2
(45) Date of Patent: Mar. 19, 2019

(54) DISPENSING ATTACHMENT FOR A SHOWER HEAD

(71) Applicant: Deborah Timmerman, Greenhithe (GB)

(72) Inventor: Deborah Timmerman, Greenhithe (GB)

( * ) Notice: Subject to any disclaimer, the term of this patent is extended or adjusted under 35 U.S.C. 154(b) by 0 days.

(21) Appl. No.: 15/661,113

(22) Filed: Jul. 27, 2017

(65) Prior Publication Data

US 2019/0030553 A1 Jan. 31, 2019

(51) Int. Cl.
*B05B 7/00* (2006.01)
*B05B 7/24* (2006.01)

(52) U.S. Cl.
CPC ..... *B05B 7/2462* (2013.01); *B05B 7/2443* (2013.01)

(58) Field of Classification Search
CPC ..... B05B 7/2462; B05B 7/2443
See application file for complete search history.

(56) References Cited

U.S. PATENT DOCUMENTS 2,485,112 A * 10/1949 Rose ..... B05B 7/2462 239/314
5,274,858 A * 1/1994 Berry ..... A47K 3/281 239/314
6,923,384 B2 * 8/2005 Cernik ..... E03C 1/0465 239/318
8,079,557 B2 * 12/2011 Tu ..... F16B 47/006 248/206.2
8,905,332 B2 * 12/2014 Luettgen ..... B05B 1/1654 239/222.11

* cited by examiner

*Primary Examiner* — Viet Le
(74) *Attorney, Agent, or Firm* — Bernhard P. Molldrem, Jr.

(57) ABSTRACT

A dispensing attachment for a shower head 1 has an attachment means 2, 3, 4 configured to allow the dispensing attachment 1 to be removably and repeatably connected to and disconnected from a shower head in normal use without modification of the shower head; a product container 6 configured to hold a quantity of body product in use, the product container 6 comprising a water receiving aperture 7, a main body 8 within which body product is located in use, and a plurality of outlet apertures 9, the attachment means 2, 3, 4 and product container 6 further configured so that when connected to a shower head, the water receiving aperture 7 will receive at least some of the water stream from the shower head, the water stream passing through the product container 6 to intermix with the contents therein and then pass through the outlet apertures 9.

16 Claims, 5 Drawing Sheets

DISPENSING ATTACHMENT FOR A SHOWER HEAD

FIELD

The present invention relates to a dispensing attachment for a shower head that enables body products to be dispensed within the water stream from the shower.

BACKGROUND

The use of luxury cosmetic and cleansing body products in the bath and shower is extremely popular, and the market for these products has grown rapidly in recent years. Companies such as 'The Body Shop' and 'Lush' specialise in providing bath and shower products such as soaps, bath bombs, bubble bars, face masks, body oils, and shampoos and hair conditioners. A user intermixes their chosen product or products with the bath or shower water in order to use the product. Products made specifically for use in the shower mainly consist of shower gels, soaps, body scrubs, body oils and in-shower body moisturisers, which are intended to be manually applied to the skin with the hands during a shower. It is known to modify an existing shower system by replacing the existing shower head and/or other components of the shower with specialist components that enable body products to be intermixed with the water stream before it is emitted from the shower head. However, this requires a user to commit to the purchase of completely new shower components in order to modify their existing showers. Their usage is also limited to the addition of liquid additives only, making these systems incompatible for use with body products such as bath bombs, salts or melts.

In this specification where reference has been made to patent specifications, other external documents, or other sources of information, this is generally for the purpose of providing a context for discussing the features of the invention. Unless specifically stated otherwise, reference to such external documents is not to be construed as an admission that such documents, or such sources of information, in any jurisdiction, are prior art, or form part of the common general knowledge in the art.

SUMMARY

It is an object of the present invention to provide a dispensing attachment for a shower head which goes some way to overcoming the abovementioned disadvantages or which at least provides the public or industry with a useful choice.

The term "comprising" as used in this specification and indicative independent claims means "consisting at least in part of". When interpreting each statement in this specification and indicative independent claims that includes the term "comprising", features other than that or those prefaced by the term may also be present. Related terms such as "comprise" and "comprises" are to be interpreted in the same manner.

As used herein the term "and/or" means "and" or "or", or both.

As used herein "(s)" following a noun means the plural and/or singular forms of the noun.

Accordingly, in a first aspect the present invention may broadly be said to consist in a dispensing attachment for a shower head, comprising: an attachment means configured to allow the dispensing attachment to be removably and repeatably connected to and disconnected from a shower head in normal use without modification of the shower head; a product container configured to hold a quantity of body product in use, the product container comprising a water receiving aperture, a main body within which body product is located in use, and a plurality of outlet apertures; the attachment means and product container further configured so that when connected to a shower head, the water receiving aperture will receive at least some of the water stream from the shower head, the water stream passing through the product container to intermix with the contents therein and then pass through the outlet apertures. This allows a user to mix body product with the water stream from the shower without having to apply the product to themselves manually.

In an embodiment, the attachment means comprises a suction device. This provides a simple and reliable mechanism that is easy to operate.

In an embodiment, the suction device comprises a lever lock suction cup configured to releasably attach to the top of a shower head. This provides a simple and reliable mechanism that is easy to operate.

In an embodiment, the suction device further comprises an infill ring configured to exert pressure on the suction cup in use. This assists the suction cup to provide a good seal in use.

In an embodiment, the product container is configured to hold a quantity of solid body product in use. This allows a user to use solid products that would otherwise only be suitable for use in a bath in a shower.

In an embodiment, the product container is configured to hold a bath bomb. This allows a user to use a bath product in a shower.

In an embodiment, the product container comprises a substantially hemispherical cup having a substantially hollow interior, and an open top that forms the water receiving aperture, the plurality of outlet apertures formed through the side wall. This provides a simple, one-piece construction that is easy to use and robust and reliable.

In an embodiment, the dispensing attachment further comprises a sealing gasket configured to locate around the edge of the cup to in use seal against a shower head. This assists with ensuring that substantially all the liquid in the cup exits through the outlet apertures.

In an embodiment, the sealing gasket is formed substantially from neoprene. This is a readily available and inexpensive material that provides a good seal.

In an embodiment, the product container further comprises at least one protrusion extending inwards from the internal side wall of the container, and configured to hold the solid body product away from the side wall and in position within a stream of water in use. This allows the water stream to pass freely through the container while still passing over and mixing with the solid product.

In an embodiment, one or more of the at least one inwardly-extending protrusion(s) are configured so that insertion into the solid body product in use is minimised. This helps to prevent disintegration of the solid product and movement of the product in use which might block the apertures.

In an embodiment, one or more of the at least one inwardly-extending protrusion(s) are formed as an elongate substantially planar protrusion with at least that part of the inwardly-facing edge that in use is in contact with the body of the solid product rounded. This is a simple structure that allows the protrusions to be formed with the container as a unitary item.

In an embodiment, the plurality of outlet apertures are formed and positioned so that in use water entering the product container will reside within the container around the quantity of body product for a short time before exiting the product container via the outlet apertures. This allows the water and product to become mixed as required before the water passes out of the container.

In an embodiment, the dispensing attachment for a shower head further comprises a pair of arms, one of each of the arms connected to and extending from the product container and the attachment means respectively, the arms pivotally connected at or towards their outer ends. This provides a simple structure that is simple to build and intuitive for a user.

In an embodiment, the dispensing attachment for a shower head further comprises a spring means connected to the arms and configured to draw the arms together when pulled apart about the pivot connection. This helps to connect the dispensing attachment to the shower in a manner that holds it to the shower head in use so that water passes through the container.

In an embodiment, the spring means comprises an elasticated band. This is a simple and robust mechanism.

In an embodiment, the ends of the elasticated band comprise end pieces configured to connect with the arms to hold the elasticated band in position. This helps to ensure that the ends of the elasticated band are retained in position when there is no tension in the band.

With respect to the above description then, it is to be realised that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

This invention may also be said broadly to consist in the parts, elements and features referred to or indicated in the specification of the application, individually or collectively, and any or all combinations of any two or more said parts, elements or features, and where specific integers are mentioned herein which have known equivalents in the art to which this invention relates, such known equivalents are deemed to be incorporated herein as if individually set forth.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

BRIEF DESCRIPTION OF THE FIGURES

Further aspects of the invention will become apparent from the following description which is given by way of example only and with reference to the accompanying drawings which show an embodiment of the device by way of example, and in which.

DETAILED DESCRIPTION

An embodiment of the invention, and variations thereof, will now be described in detail with reference to the figures.

An embodiment of dispensing attachment 1 has three main parts: a suction cup assembly 10, a product container 6, and a pair of arms 4, 5.

Figure 2:
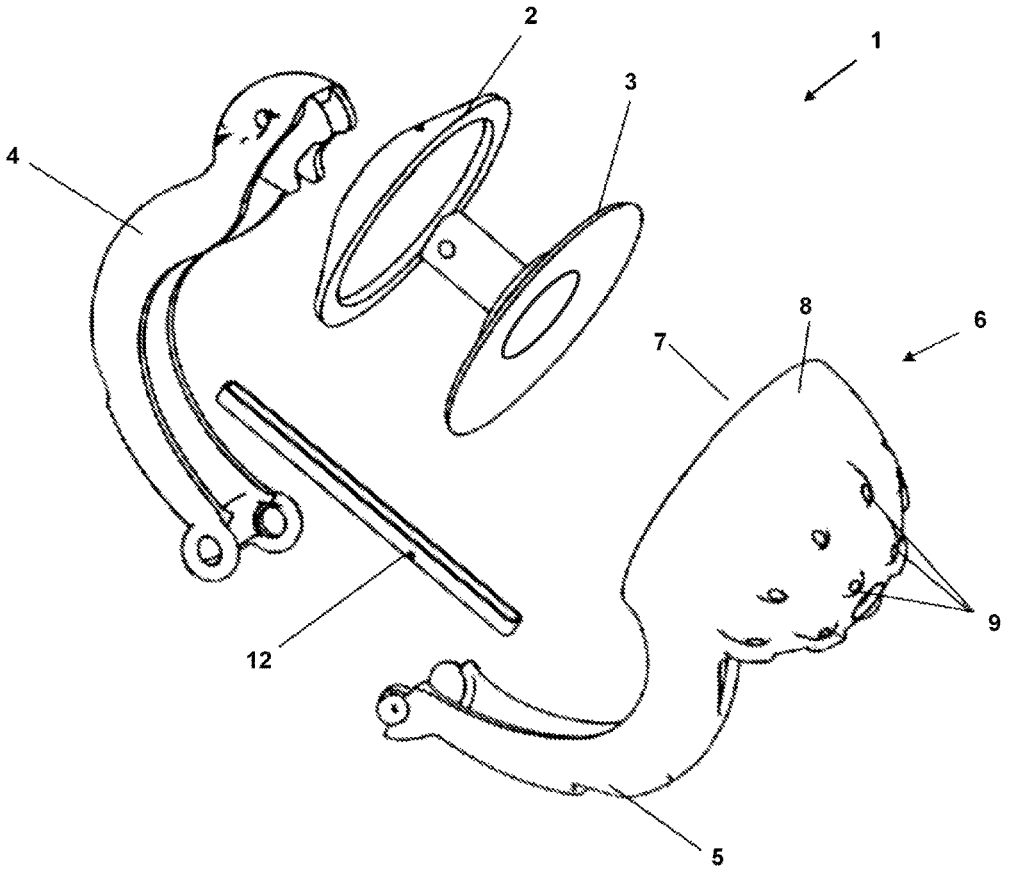
FIG. 2 shows an exploded view of the dispensing attachment of FIG. 1 from the same angle, showing further detail of the sucker assembly and the connection between the upper and lower arms and the elasticated band.

The suction cup assembly 10 is configured to allow the dispensing attachment 1 to be removably and repeatably connected to and disconnected from a shower head in normal use, without modification of the shower head. The suction cup assembly 10 is formed from three main subparts: a suction cup holder 2, a suction cup 3, and the upper arm 4. The suction cup 3 locates into the suction cup holder 2 in use, with the suction cup holder 2 mounted to the upper arm 4 close to the inner end of the arm 4. The suction cup holder 2 and suction cup 3 are mounted to the arm 4 via an attachment extension that forms part of the suction cup 3 and which extends from the rear of the suction cup 3, through the suction cup holder 2. A pin (not shown) passes through the arm 4 and the extension to hold the suction cup 3 and the suction cup holder 2 in place on the arm 4, as shown in FIG. 2. This attachment mechanism allows some pivoting of the suction cup 3 and holder 2 relative to the arm 4, utilising the fit of the suction cup holder 2 against the arm 4, and the natural flex of the materials. The suction cup 3 and cup holder 2 comprise a lever lock suction assembly that allows the suction cup 3 to be activated and deactivated. The suction cup 3 is placed on the top of the shower head, located in a central position. The centre of the suction cup 3 is pulled upwards when the suction assembly is activated, so that inside/under the suction cup 3, between the underside of the suction cup 3 and the upper surface of the shower head, is at a lower pressure than atmosphere. This holds the suction cup 3 to the top surface of the shower head. This upwards pulling on the suction cup 3 is achieved via a cam profile on the upper arm 4, which pulls the centre of the suction cup 3 upwards when activated.

The product container 6 is configured to in use hold a body product such as a bath bomb/shower bomb, or liquid soap. The product container 6 comprises an open-topped substantially hemispherical cup having a hollow interior. In use, the open top is located directly under the outlet of the shower head, and forms a top aperture or water receiving aperture 7 through which water from the shower head enters the container 6. Outlet apertures 9 are formed through the side wall. The outlet apertures 9 are formed and positioned so that in use water entering the product container will reside within the container around the outer surface of a solid body product such as a bath bomb located within the product container 6 for a short time before exiting the product container 6 via the outlet apertures 9. That is, the outlet apertures 9 are formed in the side wall away from the bottom of the product container 6. A number of protrusions 11 are formed on the inner surface of the container 6, extending inwards from the internal side wall of the container 6. These hold the solid body product away from the side wall and in position within a stream of water in use.

The majority of the inwardly-extending protrusions 11 are formed as elongate substantially planar protrusions, with the inwardly-facing edge which in use is in contact with the body of the solid product rounded so that even when the solid product softens in use, insertion of the protrusions 11 into the solid body product is minimised. In this embodiment, the protrusions 11 also comprise a single upstanding elongate cylindrical pin protrusion located at the bottom of the container, which the product locates on in use. Shower bombs are formulations of material concentrated and solidified into tablets. Once they are placed inside the product container 6 and buffeted by the water they will solubilise and intermix with the water stream before falling onto the body. Shower bomb variants include: bubble bath, bath salts, bath bombs, bath milk, bath oils, bath melts and bath creamers. If a liquid soap or similar liquid material such as for example moisturiser is used, then the water entering the product container 6 will reside in the bottom of the product container 6 before exiting via the outlet apertures 9, thus allowing the water to mix with the liquid product.

The container 6 is located at the inner end of a lower arm 5. The lower arm 5 and upper arm 4 are pivotally connected at a pivot point close to the outer ends of the arms 4, 5. An elasticated band 12 extends between the two arms 4, 5 slightly inwards of the pivot point. When the arms 4, 5 are pulled apart, the band 12 is put in extension, and draws the arms 4, 5 back together.

In use, when the suction cup 3 is connected to the upper surface of a shower head, the open top 7 of the container 6 is located directly under the outlet of the shower head. The container 6 is positioned directly below the centre of the shower head. The band 12 pulls the container 6 tight up against the underside of the shower head. The band 12 also allows for a variation in shower head thicknesses—i.e. the dispensing attachment 1 can be used with many different types of shower head with different thicknesses.

When the shower is turned on, the water stream from the shower head passes directly into the container 6, passing over the body product in the container 6 and intermixing with the substance of the body product. The mixture will then pass through the outlet apertures 9 to a user. The curved bottom of the interior surface of the product container 6 assists with this mixing process.

It can be seen that a dispensing attachment 1 according to the present invention easily attaches to and detaches from virtually any shower head via the suction cup 3. It houses a solid water soluble shower additive (shower bomb) and dispenses this into the water stream emitted from a shower head. The dispensing attachment 1 allows the material that forms the shower bomb to intermix with a portion of the water stream, the intermixed material and water then discharged as a homogeneous continuous flow through the apertures 9.

The positioning of the apertures 9 allows the water to build up around the shower bomb instead of passing straight through. This allows the material of the shower bomb to dissolve, intermix and become homogeneous with the water stream. In variants, the apertures could be positioned so as to allow a gel or other liquid or semi-liquid material to be used, the gel stored in the container 6 in such a way that it can only pass through the apertures 9 when it has first intermixed with the water stream.

Figure 1:
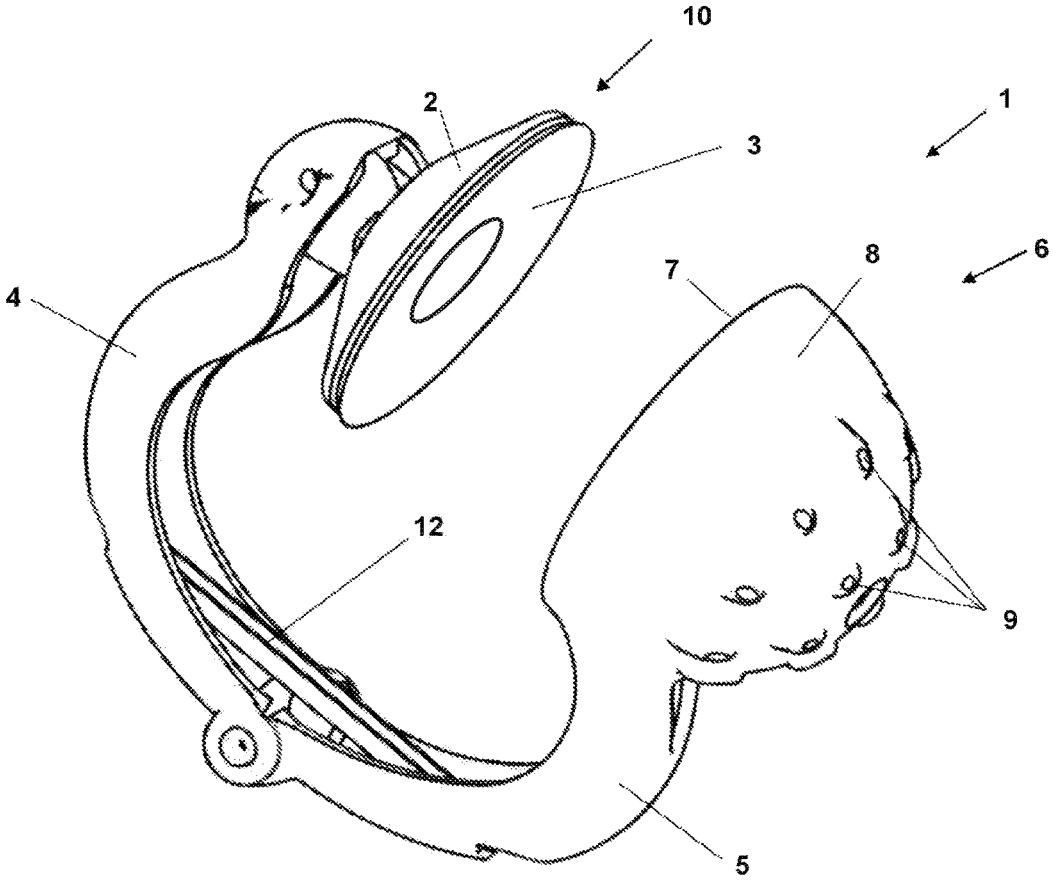
FIG. 1 shows a perspective view from the side and front of a dispensing attachment for a shower head according to an embodiment of the invention, the dispensing attachment suitable for use with a solid body product such as a bath bomb, the dispensing attachment having an upper arm and a lower arm that are pivotally connected at an outer end and drawn together by an elasticated band, a sucker assembly located at the inner end of the upper arm that allows the dispensing attachment to be removably and repeatably connected to and disconnected from a shower head in use without modification of the shower head, a product container located at the outer end of the lower arm that holds a quantity of body product in use and which is located directly below the outlet of the shower head when the dispensing attachment is connected to the shower head, the product container having a main body with an open top within which body product is located in use, water from the shower head entering the main body through the open top to intermix with the body product, a plurality of outlet apertures formed in the side wall of the product container so that the intermixed body product and water can exit the product container by passing through the outlet apertures.
Figure 3:
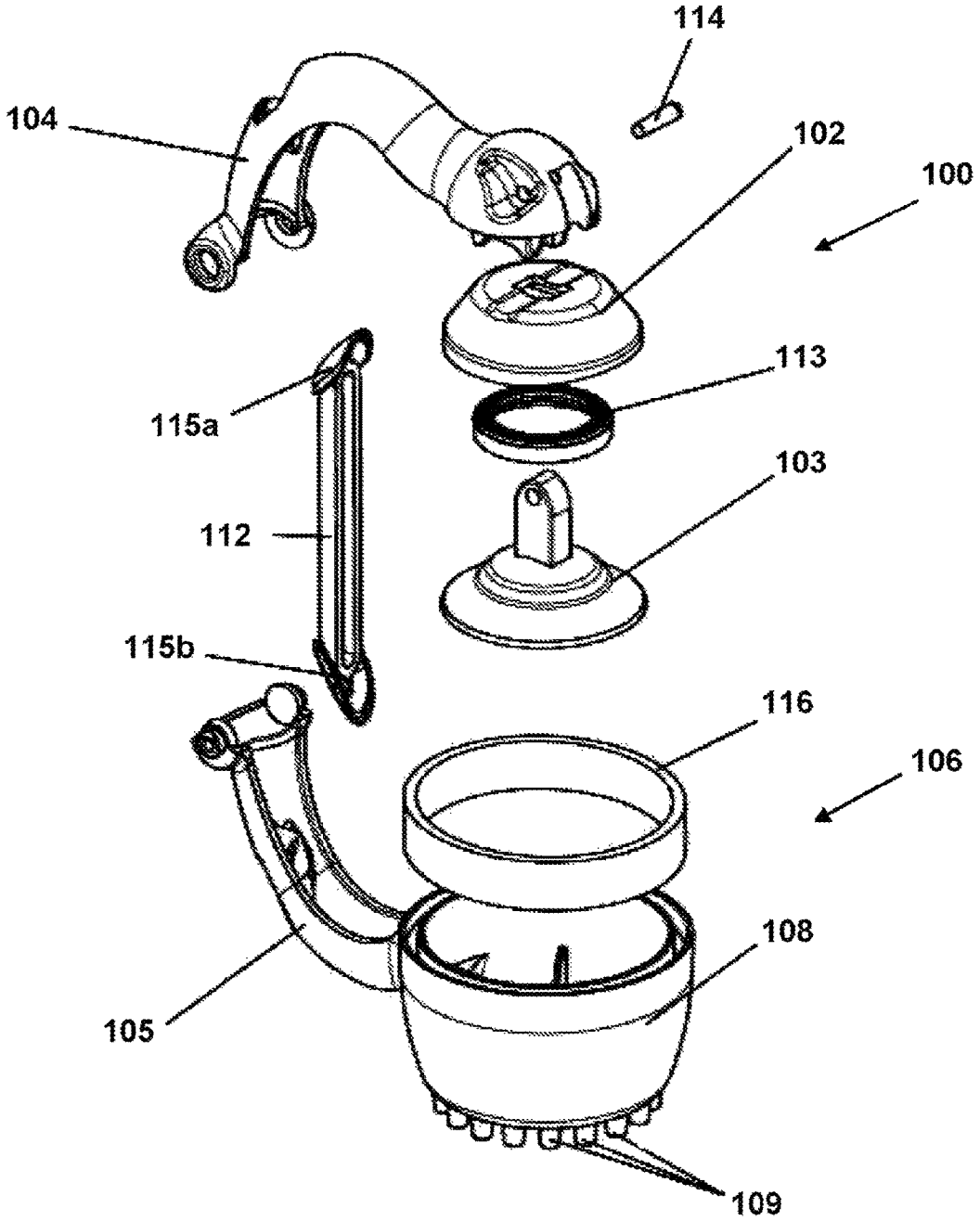
FIG. 3 shows an exploded view from the side and front and slightly above of a variation of the dispensing attachment for a shower head shown in FIGS. 1 and 2, the sucker assembly in this variation having an infill ring located between a suction cup holder and the suction cup, and different outlet apertures.
Figure 4:
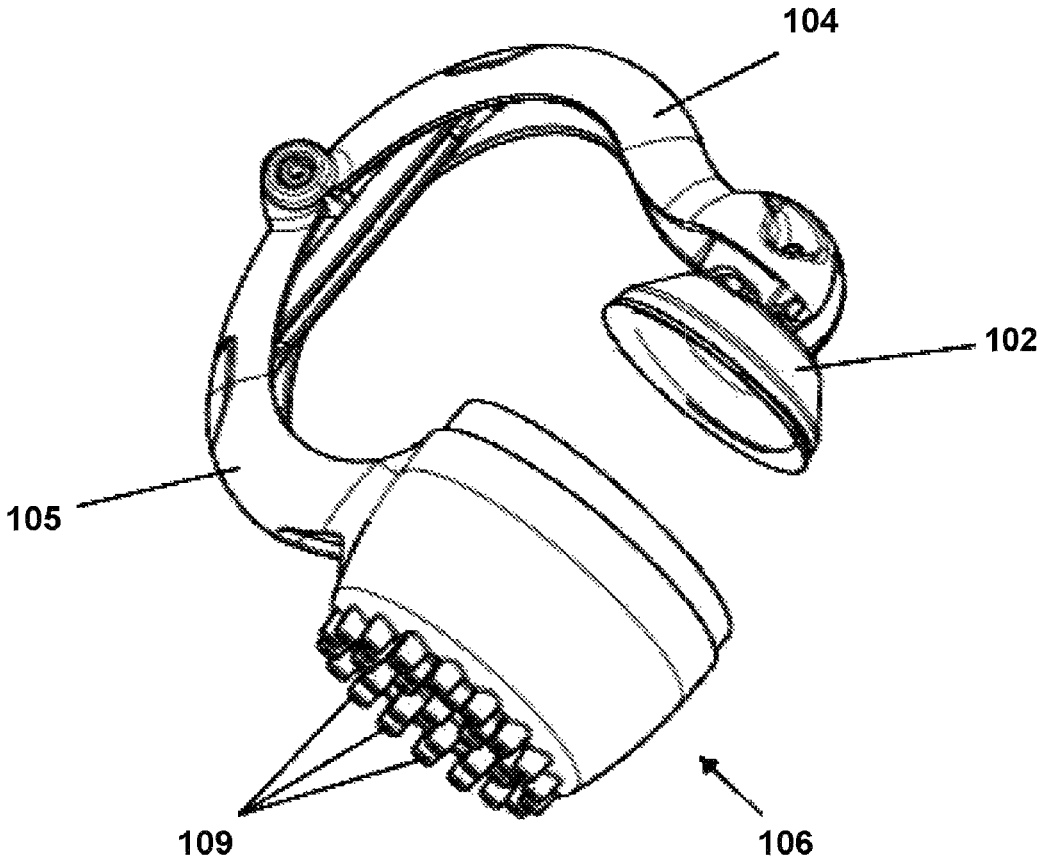
FIG. 4 shows a perspective view from the front of the dispensing attachment of FIG. 3.
Figure 5:
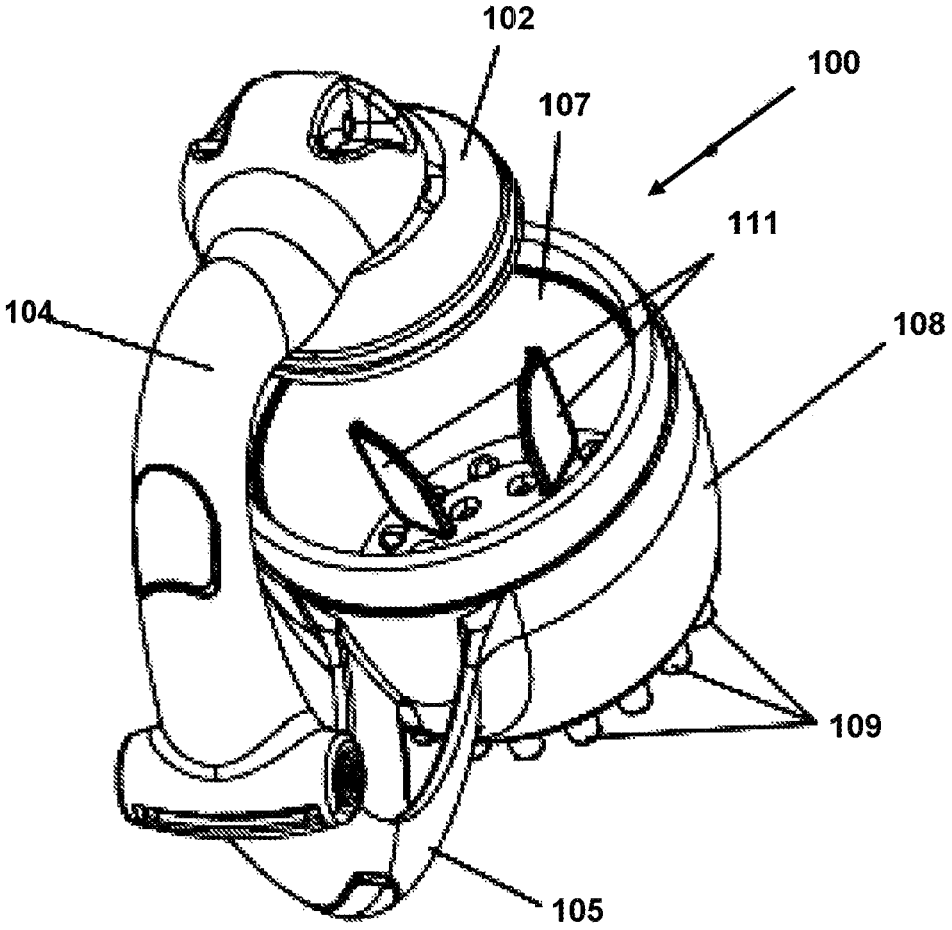
FIG. 5 shows a perspective view from behind of the dispensing attachment of FIGS. 3 and 4, with detail of the interior of the product container shown, a number of inwardly-extending substantially planar elongate protrusions formed on the inner surface of the product container, to hold a bath bomb or similar in position and away from the side wall so that water can flow around the bath bomb and intermix with the substance that forms the bomb in use, the edges of the protrusions rounded and smooth to minimise amount by which the bath bomb sticks to them.

A variation of the dispensing attachment of the present invention is shown in FIGS. 3, 4 and 5. The dispensing attachment 100 of this variation is substantially the same as that shown in FIGS. 1 and 2, with differences as described below. Similar numbering is used for equivalent features—e.g. suction cup holder 102 is equivalent to suction cup holder 2, suction cup 103 is equivalent to suction cup 3, upper arm 104 is equivalent to upper arm 4, etc.

In this variation or second embodiment, the suction cup holder 102 has been sculpted on the underside so that it is compatible with different forms of shower head.

In this variation, there is an infill ring 13 located between the suction cup 103 and suction cup holder 102. The infill ring in use applies pressure onto the suction cup so a secure suction or secure seal is formed for all typical shapes and forms of shower head.

Pin 14 is shown passing through the arm 104 and the extension to hold the suction cup 103 and the suction cup holder 102 in place on the arm 104, as shown in FIG. 3. This arrangement is substantially the same for both variations. However, the pin is not shown in the figures for the first variation.

Elastic band 112 in this variation has two end pieces 115*a* and 115*b* connected to the ends of the main body of the band 112. These end pieces connect with the arms 104, 105 to prevent the band 112 disconnecting from the assembly. When the dispensing attachment 1 is not in use (for example when the dispensing attachment 1 is in storage or in it's packaging, or during assembly or attachment to a shower head for use) the dispensing attachment 1 is usually in a closed position (i.e. with the arms rotated towards one another), and the elastic band 112 is not in tension. This can lead to the band disconnecting from the arms, which can inconvenience a user. The end pieces 115 connect to the arms by engaging with equivalently shaped slots or apertures on the inner sides of the arms, to hold the ends of the band in place on the arms.

The upper arm 104 of this variation has two cam profile positions. This allows the dispensing attachment 1 to sit at an additional angle to the shower head, again allowing compatibility with more unusual shower head forms.

A neoprene gasket 116 is located on the top edge of the container 106. This forms a seal with the underside of the shower head in use, to prevent liquid exiting over the top of the container 106 and ensuring that substantially all of the liquid entering the container in use exits the container via the outlet apertures 109 at maximum pressure. This helps to ensure that a user experiences the desired jets of liquid rather than an interrupted flow that could occur if liquid flowed over the top of the container 106.

It should be noted that the embodiments of dispensing attachment described above have been described for use with bath bombs or similar body products. It should be noted that a dispensing attachment according to the invention would also be suitable for use with other personal care products, such as for example therapeutic or medical products. When 'body products' is used in this specification, this should be taken to mean any suitable type of product, and should not be taken as limiting the device to use with cosmetic body products, or solid or semi-solid products such as the bath bomb described in the embodiment above. The dispensing attachment could easily be modified for use with other solid or semi-solid products, cosmetic, therapeutic or medical products, and could also be modified for use with gels, liquids or similar, without departing from the scope of the invention.

It should also be noted that the attachment means described for the embodiments above comprises a suction cup assembly suitable for use with showers of the round-head type. This could easily be modified for use with different types and styles of shower head, by using differently-shaped suction cups and bowls to suit shower heads of, for example, the thin tube type. Clips, straps, elasticated straps, or clamps could also be used as part of a suitable attachment means.

Although the inner surface of the containers 6 and 106 above has been described as substantially hemispherical, it should be noted that the internal surfaces could be curved in a non-spherical or non-hemispherical manner, and still allow the advantages of water residing and intermixing as outlined above. The curved internal surface allows the water entering the containers 6, 106 to intermix thoroughly with product in the containers, whether solid or liquid.

The invention claimed is:

1. A dispensing attachment for a shower head that provides a water stream, comprising:

an attachment means configured to allow the dispensing attachment to be removably and repeatably connected to and disconnected from the shower head in normal use without modification of the shower head;

a product container configured to hold a quantity of body product in use, the product container comprising a water receiving aperture, a main body which is configured to hold said body product, and a plurality of outlet apertures;

the attachment means and product container further being configured so that when connected to a shower head, the water receiving aperture will receive at least some of the water stream from the shower head, the water stream passing through the product container to intermix with the contents therein and then passing through the outlet apertures, the outlet apertures and product container being configured so that water entering the product container will reside within the container and intermix with at least a part of the quantity of body product before exiting the product container via the outlet apertures; and further comprising a pair of arms, one of the arms being connected to and extending from the product container and the other of the arms being connected to and extending from said attachment means, the arms having a pivot connection at or towards their respective ends remote from the product container and the attachment means, respectively; and a spring means connected to the arms respectively, and configured to draw the arms together when pulled apart about the pivot connection.

2. A dispensing attachment for a shower head as claimed in claim 1 wherein the outlet apertures are located in a side wall of the product container.

3. A dispensing attachment for a shower head as claimed in claim 1 wherein at least a lower inner surface of the product container is curved.

4. A dispensing attachment for a shower head as claimed in claim 1 wherein the attachment means comprises a lever lock suction cup device.

5. A dispensing attachment for a shower head as claimed in claim 4 wherein the lever lock suction cup device is configured to releasably attach to a top of a shower head.

6. A dispensing attachment for a shower head as claimed in claim 5 wherein the suction device further comprises an infill ring configured to exert pressure on the lever lock suction cup device.

7. A dispensing attachment for a shower head as claimed in claim 1 wherein the product container is configured to hold a quantity of solid body product.

8. A dispensing attachment for a shower head as claimed in claim 7 wherein the product container is configured to hold a bath bomb.

9. A dispensing attachment for a shower head as claimed in claim 7 wherein the product container further comprises at least one protrusion extending inwards from an internal side wall of the container, and configured to hold the solid body product away from the side wall and in position within the stream of water.

10. A dispensing attachment for a shower head as claimed in claim 9 wherein one or more of the at least one inwardly-extending protrusion(s) are configured to be inserted into the solid body product.

11. A dispensing attachment for a shower head as claimed in claim 10 wherein one or more of the at least one inwardly-extending protrusion(s) are formed as an elongate substantially planar protrusion with at least a portion of the inwardly-facing edge, that is configured to be in contact with the body of the solid product, is rounded.

12. A dispensing attachment for a shower head as claimed in claim 1 wherein the product container comprises a substantially hemispherical cup having a substantially hollow interior, a side wall, and an open top that forms the water receiving aperture, the plurality of outlet apertures being formed through the side wall.

13. A dispensing attachment for a shower head as claimed in claim 12 further comprising a sealing gasket configured to locate around the edge of the cup to seal against the shower head.

14. A dispensing attachment for a shower head as claimed in claim 13 wherein the sealing gasket is formed substantially from neoprene.

15. A dispensing attachment for a shower head as claimed in claim 1 wherein the spring means comprises an elasticated band.

16. A dispensing attachment for a shower head as claimed in claim 15 wherein the ends of the elasticated band each comprise one or more end pieces configured to connect with the arms to hold the elasticated band in position.

* * * * *